US008855532B2

(12) United States Patent
Tonohiro

(10) Patent No.: US 8,855,532 B2
(45) Date of Patent: Oct. 7, 2014

(54) IMAGE FORMING APPARATUS AND IMAGE FORMING METHOD FOR FORMING AN IMAGE COVERING ANOTHER IMAGE BY A COLOR ERASABLE RECODING MATERIAL

(75) Inventor: Chie Tonohiro, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 330 days.

(21) Appl. No.: 13/223,768

(22) Filed: Sep. 1, 2011

(65) Prior Publication Data

US 2012/0082472 A1 Apr. 5, 2012

Related U.S. Application Data

(60) Provisional application No. 61/389,897, filed on Oct. 5, 2010.

(51) Int. Cl.
*G03G 21/00* (2006.01)
*G03G 15/00* (2006.01)

(52) U.S. Cl.
CPC ..... *G03G 15/6585* (2013.01)
USPC ..... 399/127; 399/411

(58) Field of Classification Search
USPC ..... 399/66, 127, 130, 37, 407, 411
See application file for complete search history.

(56) References Cited

U.S. PATENT DOCUMENTS 5,572,311 A * 11/1996 Abe et al. ..... 399/127
5,872,076 A 2/1999 Kobayashi et al.
5,970,272 A * 10/1999 Kobayashi et al. ..... 399/411 X
2009/0154970 A1* 6/2009 Yoshida et al. ..... 399/341
2010/0097421 A1 4/2010 Yoshida et al.

FOREIGN PATENT DOCUMENTS

| | | |
|---|---|---|
| CN | 1869835 | 11/2006 |
| CN | 101722725 | 6/2010 |
| JP | 2005-170014 | 6/2005 |
| JP | 2010-100044 | 5/2010 |

OTHER PUBLICATIONS

First Office Action of Reasons of Rejection for Japanese Patent Application No. 2011-192608 Dated Jun. 25, 2013, 4 pgs.
Notification of the First Office Action for Chinese Patent Application No. 201110294881.9 Dated Dec. 5, 2013, 38 pgs.

* cited by examiner

*Primary Examiner* — Sandra Brase
(74) *Attorney, Agent, or Firm* — Amin, Turocy & Watson, LLP

(57) ABSTRACT

According to one embodiment, the image forming apparatus includes an image carrier the surface of which is charged at a predetermined potential, an exposure device which forms a latent image by exposing the surface of the image carrier, a developing unit which develops a toner image generated using color erasable toner on the latent image formed on the surface of the image carrier, a transfer unit which transfers the toner image to a recording medium, and a controller which controls an operation for transferring a toner image of the color erasable toner to a printed surface of the recording medium to cover a printed portion of the recording medium to which the color erasable toner has been fixed.

10 Claims, 6 Drawing Sheets

IMAGE FORMING APPARATUS AND IMAGE FORMING METHOD FOR FORMING AN IMAGE COVERING ANOTHER IMAGE BY A COLOR ERASABLE RECODING MATERIAL

CROSS-REFERENCE TO RELATED APPLICATION

This application is based upon and claims the benefit of U.S. Provisional Application 61/389,897, filed on Oct. 5, 2010; the entire contents of which are incorporated herein by reference.

FIELD

Embodiments described herein relate generally to an image forming apparatus and an image forming method.

BACKGROUND

In the related art, there is known an image removal apparatus which removes an image on a sheet which is formed using color erasable toner, so as to reuse the sheet when forming a subsequent image. With the color erasable toner, color erasing is performed such that the connection between a pigment and a color former in the toner is lost by heating the toner. In an image forming apparatus in the related art, for example, it is necessary to heat the sheet at 120° C. to 150° C. for color erasing of a toner image.

DETAILED DESCRIPTION

In general, according to one embodiment, the image forming apparatus includes an image carrier the surface of which is charged at a predetermined potential, an exposure device which forms a latent image by exposing the surface of the image carrier, a developing unit which develops a toner image generated using color erasable toner on the latent image formed on the surface of the image carrier, a transfer unit which transfers the toner image to a recording medium, and a controller which controls an operation for transferring a toner image of the color erasable toner to a printed surface of the recording medium to cover a printed portion of the recording medium to which the color erasable toner has been fixed.

Hereinafter, embodiments of the invention will be described.

First Embodiment

Figure 1:
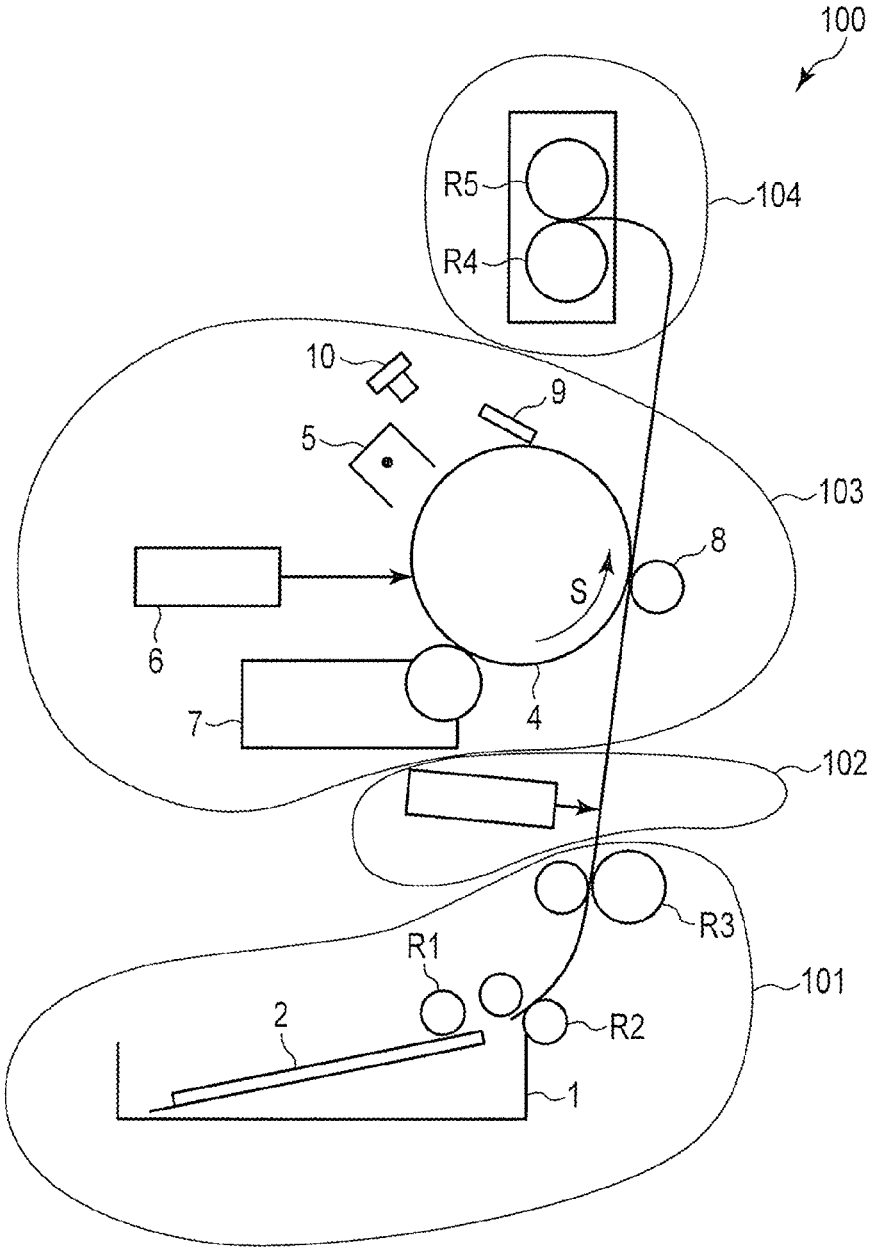
FIG. 1 is an exemplary diagram which shows a schematic configuration of an image removal apparatus provided with an image forming apparatus according to a first embodiment.

FIG. 1 is an exemplary diagram which shows a schematic configuration of an image forming apparatus according to a first embodiment.

The image forming apparatus 100 is provided with a sheet feeding unit 101, an image reading unit 102, an image forming unit 103, and an image fixing unit (a color erasing unit) 104.

The sheet feeding unit 101 supplies a sheet on which printing is already performed using color erasable toner (hereinafter, referred to as color erasing toner), to the image forming unit 103. The image reading unit 102 reads a printed state of the sheet. The image forming unit 103 further transfers the color erasing toner to the supplied sheet and transports it to the fixing unit 104. The fixing unit 104 fixes the image of the color erasing toner, which is transferred to the sheet, to the sheet, by applying heat. The fixing unit 104 performs a fixing operation and removes an image of color erasing toner on the sheet by applying heat of a predetermined temperature or higher. Subsequently, configurations and functions of the image forming apparatus 100 will be described.

When an image erasing operation is started, a sheet 2 on which printing is already performed using the color erasing toner which is accommodated in a sheet feeding tray 1, is taken out from a sheet feeding roller R1. The sheet 2 is transported using a transport roller R2. In the transporting process, the reading unit 102 reads a printed surface of the sheet and specifies a portion where printing is performed already. Printing is performed using the color erasing toner in the image forming unit 103 according to the specified printed portion.

The image forming unit 103 is provided with a photo conductive drum 4, a charger 5, a laser exposure device 6, a developing unit 7, a transfer roller 8, a cleaner 9, and a neutralizing LED 10.

The photo conductive drum 4 is an OPC (Organic Photo Conductor) which has an organic photo conductive layer on a surface of a supporting member. The photo conductive drum 4 is driven in a direction of an arrow
at a predetermined rim speed.

The charger 5 uniformly and sequentially charges the photo conductive drum 4 at a predetermined potential, according to a rotation of the photo conductive drum 4. The laser exposure device 6 irradiates the photo conductive drum 4 with laser light at an irradiating position on the charged photo conductive drum 4 according to image information which will be explained later. Further, an electrostatic latent image is formed on the photo conductive drum 4.

The developing unit 7 uses a heterogeneity developer which is a mixture of color erasing toner and a magnetic carrier. A developing bias of a predetermined potential is applied to a developing roller of the developing unit 7, the electrostatic latent image on the photo conductive drum 4 is developed due to a reversal processing, and a toner image is formed on the photo conductive drum 4.

Meanwhile, the sheet 2 is fed from a sheet feeding tray 1. The sheet 2 is transported to a position of the transfer roller 8 in synchronization with a formation of the toner image on the photo conductive drum 4, using the resist roller R3. The toner image on the photo conductive drum 4 is transferred to the sheet 2.

The fixing unit (the color erasing unit) 104 is disposed at the rear of the image forming unit 103. The sheet 2 to which the toner image is transferred, is sent to the fixing unit (the color erasing unit) 104 after being separated from the photo conductive drum 4. The fixing unit (the color erasing unit) 104 heats and presses the sheet 2 which is a recording medium. The image of the color erasing toner on the sheet, which is formed, loses its color when the image is heated at a predetermined temperature or at a temperature higher than the predetermined temperature, and the connection between a pigment of the color erasing toner and a color former is lost due to the heat. The fixing unit (the color erasing unit) 104 includes a roller R4 and a roller R5 which are a pressure rotation body, and is in press-contact with the roller R4. The sheet 2 is inserted between the roller R4 and the roller R5, and the toner image thereon is heated and pressed. In this manner, the image of the color erasing toner which is originally printed on the sheet 2 is erased at the same time as a newly transferred image of the color erasing toner is fixed and erased. The sheet 2 is discharged in a predetermined direction after the color of the toner image of the color erasing toner is erased, in the fixing unit (the color erasing unit) 104.

In addition, in the photo conductive drum 4, the cleaner 9 cleans remaining toner, remaining charges are removed using the neutralizing LED 10, and the image forming process is ended.

Figure 2:
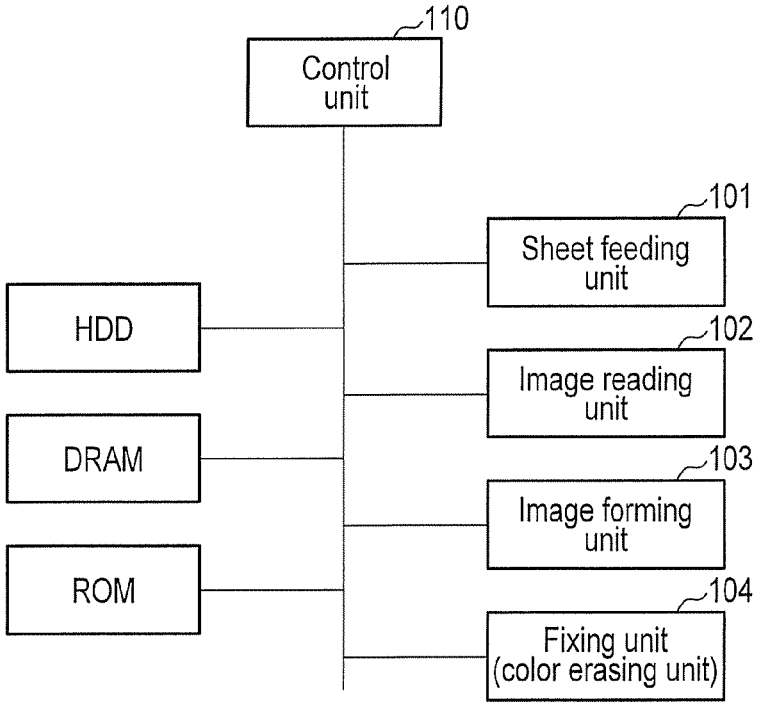
FIG. 2 is an exemplary block diagram which shows a configuration of a control system of the image removal apparatus according to the first embodiment.

FIG. 2 is an exemplary block diagram which shows a configuration of a control system of the image forming apparatus 100 according to the first embodiment.

The image forming apparatus 100 further includes a control unit 110, a ROM, a DRAM, and an internal storage device (HDD) along with the above-mentioned sheet feeding unit 101, image reading unit 102, image forming unit 103, and fixing unit (the color erasing unit) 104. In addition, all of the units are connected to each other through a system bus.

The control unit 110 controls each of the units, which are connected to each other through the system bus. The ROM stores a variety of control programs which are necessary when the image forming apparatus 100 is operated. In the ROM, each program for controlling an image forming operation and an image removing operation which will be described later, is stored. An execution of each program is controlled by the control unit 110. The DRAM is a buffer memory which temporally stores data which is generated when executing each program.

Next, a color erasing method according to the first embodiment will be described.

As described above, in the embodiment, when color erasing is performed on the fixed image, the color erasing toner is further printed on the printed surface of the sheet.

Figure 3:
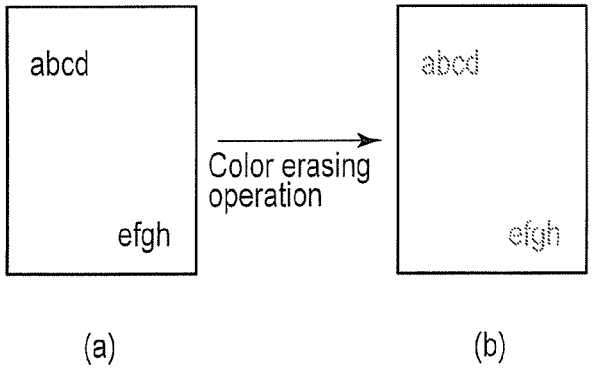
FIG. 3 is an exemplary diagram which describes uneven color erasing according to the first embodiment.

FIG. 3 is an exemplary diagram which describes uneven color erasing according to the first embodiment.

FIG. 3(*a*) is an example of a printed character or an image which is printed using the color erasing toner. When color erasing is going to be performed on the image on the sheet using the image forming apparatus in the related art, there may be a case where uneven color erasing is generated. FIG. 3(*b*) shows an example of uneven color erasing. Uneven color erasing is a state where a part of a shape or a part of a characterized portion of an original residual image is visible, even though the concentration thereof is thin.

Meanwhile, the color erasing process is a phenomenon where the color of the toner image is removed when a connection between the pigment of the color erasing toner and the color former is disconnected due to heat. That is, the toner on the sheet is not removed, but changed to be transparent. Accordingly, even though the toner becomes transparent, there is a possibility that it can be visible as uneven color erasing due to the reflective characteristics.

In this manner, when a sheet on which the original image has been erased is used, it is necessary to secure the visibility of a newly printed image. Accordingly, it is necessary to consider a measure which changes the original image such that a part of the shape or a part of the characterized portion of the original image is not seen.

Figure 4:
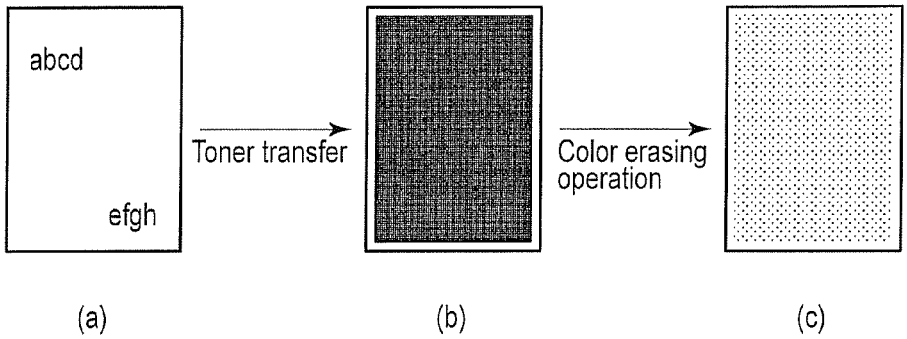
FIG. 4 is an exemplary diagram which describes a color erasing method according to the first embodiment.

FIG. 4 is an exemplary diagram which describes a color erasing method according to the first embodiment.

As shown in FIG. 4, in the image forming unit 103, the color erasing toner is transferred to the entire surface of the sheet 2. Further, the fixing unit (the color erasing unit) 104 performs the color erasing operation on the sheet 2 to which the color erasing toner is transferred to the entire surface thereof. As a result, a part of the shape or a part of the characterized portion of the original image becomes invisible, and it is possible to secure the visibility of the newly printed image. In addition, a pattern of the color erasing toner to be transferred to the entire surface of the sheet 2 may be a random pattern or a uniform pattern such that the visibility of the newly printed image can be secured. Further, it is desirably a uniform pattern; however, the color or types of the color erasing toner to be used are not particularly limited.

Second Embodiment

In a second embodiment, a pattern of a color erasing toner to be transferred to a sheet 2 is different from that of the first embodiment, in an image forming unit 103. Accordingly, the same portions as those of the first embodiment will be denoted by the same reference numerals, and detailed descriptions thereof will be omitted.

Figure 5:
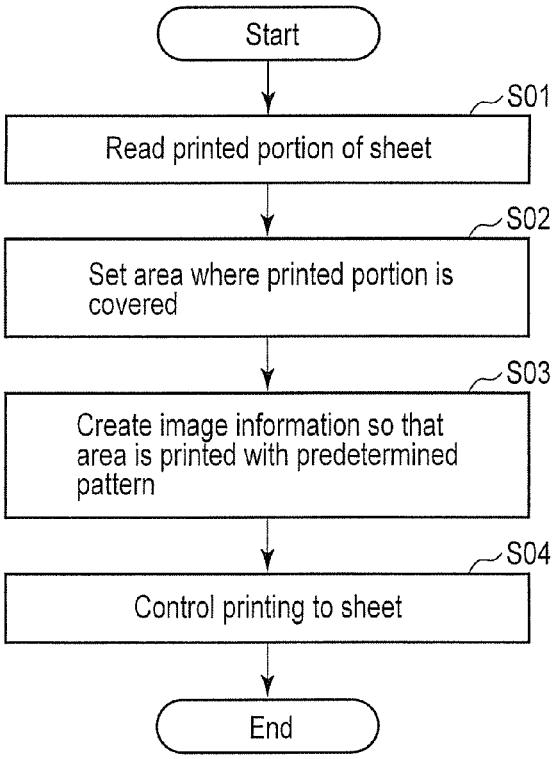
FIG. 5 is an exemplary flow chart which shows an operation of an image forming apparatus according to a second embodiment.
Figure 6:
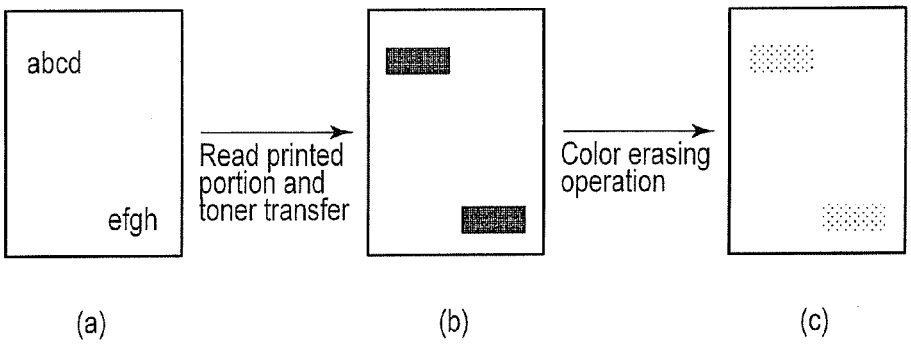
FIG. 6 is an exemplary diagram which describes a color erasing method according to the second embodiment.

FIG. 5 is an exemplary flow chart which shows an operation of an image forming apparatus 100 according to the second embodiment. FIG. 6 is an exemplary diagram which describes a color erasing method according to the second embodiment. The operation of the image forming apparatus 100 will be described with reference to FIGS. 5 and 6.

In S01, an image reading unit 102 reads a printed surface of a sheet 2 which is extracted by a sheet feeding roller R1 and transported. FIG. 6(*a*) shows a state of the read printed surface. In S02, a control unit 110 sets an area where a printed portion of the printed surface (hereinafter, referred to as a printed portion) is covered. In FIG. 6(*b*), two areas are set. In addition, when each printed portion is within a predetermined distance, it may be considered as a continuous printed portion, and be set as one area. Further, the area is not limited to a rectangular shape, but may be a circular shape, an oval shape, or may be surrounded by an arbitrary looped curve.

In S03, a control unit 110 creates image information so that the set area is printed with a predetermined pattern. The predetermined pattern may be a random pattern or a uniform pattern. For example, the predetermined pattern may be a solid pattern, a half tone pattern, a parallel line pattern, or the like. In S04, the control unit 110 controls each unit of the image forming unit 103 so that color erasing toner is printed on the sheet 2, on the basis of the image information.

FIG. 6(*c*) shows the printed surface of the sheet 2 to which the toner image is erased in a fixing unit (a color erasing unit) 104. Even though there still remains uneven color erasing in the printed portion after erasing, a characteristic shape or the like of an original image is not shown, because a toner layer in uneven color erasing is made uniform. Accordingly, it is possible to prevent a printed image in the subsequent printing process from being invisible.

Third Embodiment

In a third embodiment, a method of transferring color erasing toner to a sheet 2 is different from that of the first embodiment, in an image forming unit 103. Accordingly, the same portions as those of the first embodiment will be denoted by the same reference numerals, and detailed descriptions thereof will be omitted.

Figure 7:
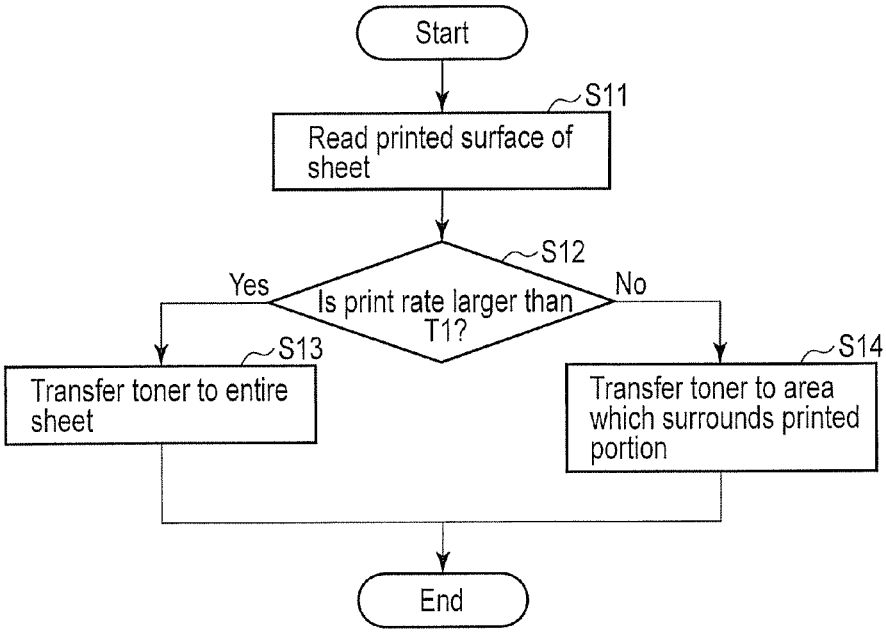
FIG. 7 is an exemplary flow chart which shows an operation of the image forming apparatus according to a third embodiment.

FIG. 7 is an exemplary flow chart which shows an operation of an image forming apparatus 100 according to the third embodiment.

In S11, an image reading unit 102 reads a printed surface of a sheet 2 which is extracted by a sheet feeding roller R1 and transported. In S12, a control unit 110 checks whether or not a print rate of the read printed surface is larger than the predetermined value T1. The print rate is a value which is shown by the following expression (1), $$\text{Print rate} = (\text{area where toner is occupying on sheet})/(\text{total area of sheet}) \quad \text{Expression (1)}$$

When the print rate is larger than the predetermined value T1 (Yes, in S12), in S13, the control unit 110 controls the image forming unit 103 to transfer color erasing toner to the entire surface of the sheet 2, similarly to the first embodiment. When the print rate is equal to or smaller than the predetermined value T1 (No, in S12), in S14, the control unit 110 controls the image forming unit 103 so as to transfer the color erasing toner to an area surrounding the printed portion, similarly to the second embodiment.

When the print rate is high, there is a case where a plurality of areas surrounding the printer portion is present in the sheet. In such a case, conversely, there is a high possibility that an image printed in the next printing process will become difficult to see, because color erasing toner is transferred to the area.

In addition, in S12, the printing method is changed by the print rate; however, the printing method may be changed using the number of areas surrounding the printed portion. That is, if the number of areas is equal to or more than a predetermined number, the color erasing toner is transferred to the entire surface of the sheet 2. If the number of areas is smaller than the predetermined number, the color erasing toner is transferred to the area surrounding the printed portion.

Fourth Embodiment

In a fourth embodiment, a method of transferring color erasing toner to a sheet 2 is different from that of the first embodiment, in an image forming unit 103. Accordingly, the same portions as those of the first embodiment will be denoted by the same reference numerals, and detailed descriptions thereof will be omitted.

Figure 8:
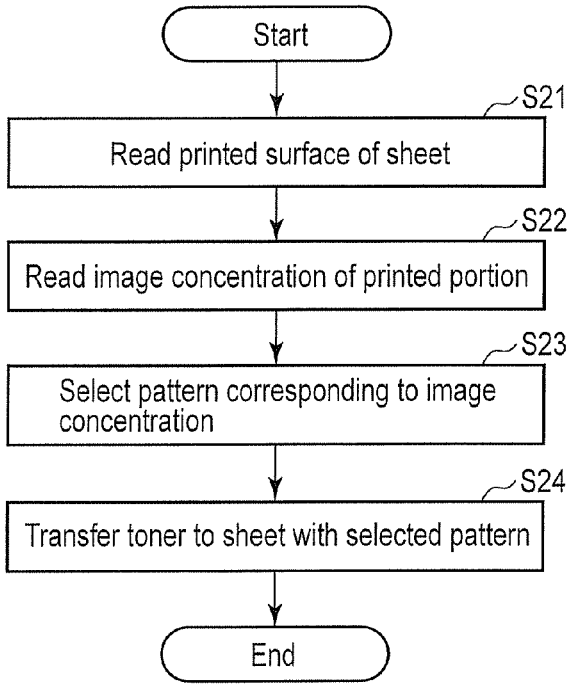
FIG. 8 is an exemplary flow chart which shows an operation of an image forming apparatus according to a fourth embodiment.

FIG. 8 is an exemplary flow chart which shows an operation of an image forming apparatus 100 according to the fourth embodiment.

In S21, an image reading unit 102 reads a printed surface of the sheet 2 which is taken out by a sheet feeding roller R1 and transported. In S22, the control unit 110 extracts the image concentration of the printed portion on the read printed surface. Here, the concentration of the image on the printed portion to be extracted may be the maximum value of the image concentration of each printed portion or may be a mean value of each printed portion. The image concentration can correspond to a reflected luminance of light irradiated to the image. That is, when the reflected luminance is high, the image concentration is low and when the reflected luminance is low, the image concentration is high. In S23, the control unit 110 selects an image pattern according to the image concentration.

Figure 9:
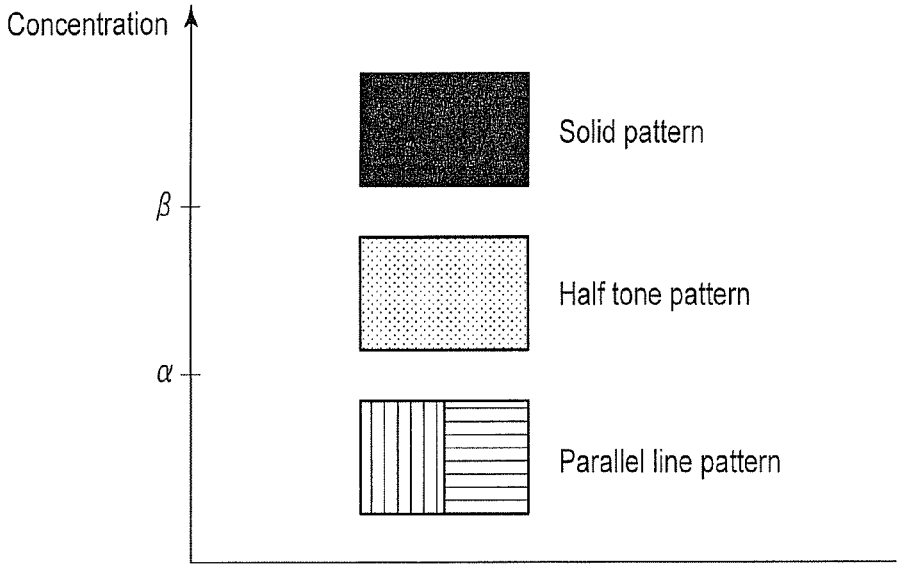
FIG. 9 is an exemplary diagram which shows an image pattern according to the fourth embodiment.

FIG. 9 is an exemplary diagram which shows an image pattern according to the fourth embodiment.

For example, when the image concentration is equal to or lower than $\alpha$, a thin parallel line pattern is selected as an image pattern. When the image concentration is higher than $\alpha$ and equal to or lower than $\beta$, a half tone pattern is selected. When the image concentration is higher than $\beta$, a solid pattern is selected. That is, when the image concentration is high, a pattern with high concentration or a pattern with high image density is selected. When the image density is low, a pattern with low concentration or a pattern with low image density is selected.

In S24, the control unit 110 transfers color erasing toner to the sheet using the selected pattern. In addition, when transferring the color erasing toner, the toner may be transferred to the entire surface of the sheet or may be transferred to the printed portion. In addition, the portion to be transferred may be selected according to the print rate, similarly to the third embodiment.

In the embodiments described above, the image forming unit 103 is an electrographic printing unit (including the photo conductive drum 4, the charger 5, the laser exposure device 6, the developing unit 7, the transfer roller 8, the cleaner 9, and the neutralizing LED 10). However, the present invention does not have to use color erasing toner but may use color erasing ink instead. In other words, the image forming unit 103 of the embodiment shown in FIG. 1 may be replaced with an inkjet printing unit (inkjet head).

Figure 10:
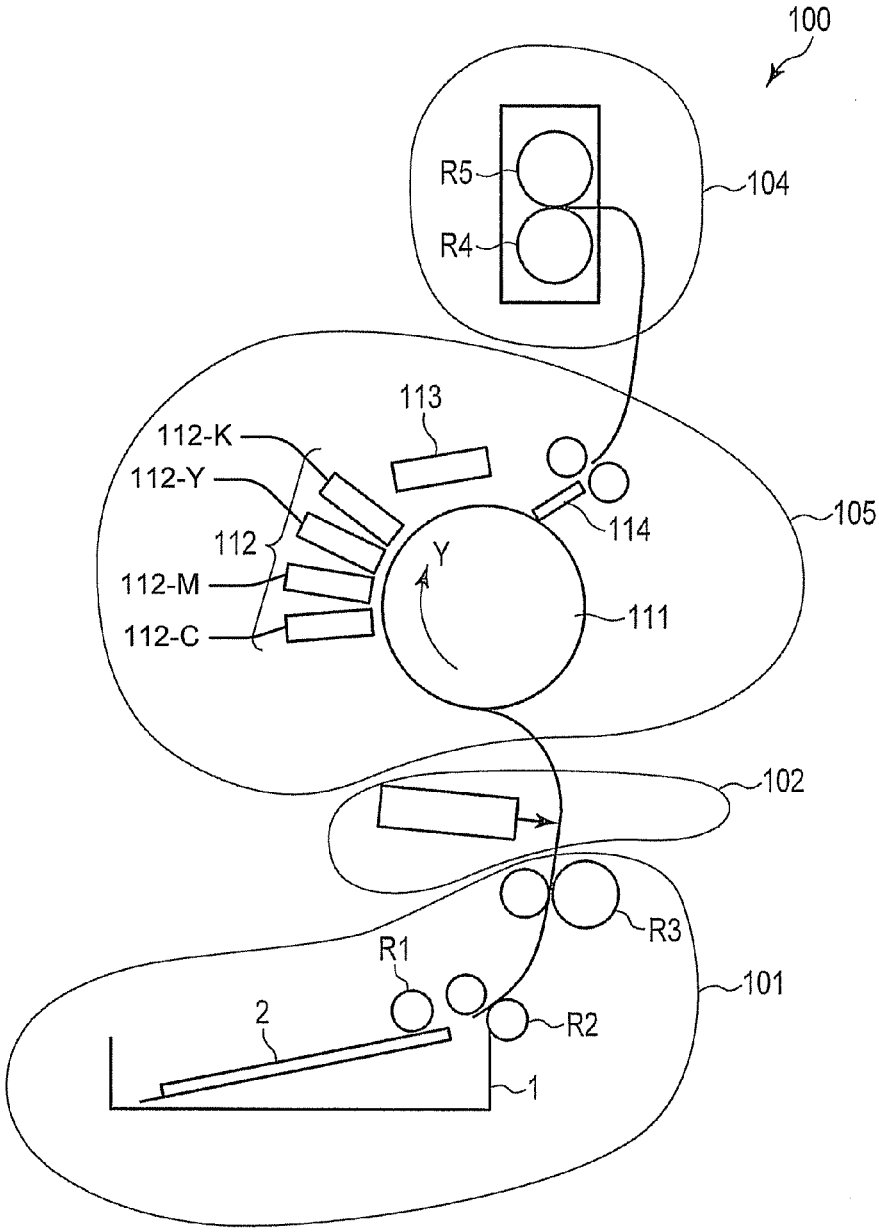
FIG. 10 is an exemplary diagram which shows a schematic configuration of an image removal apparatus provided with an image forming apparatus according to a fifth embodiment.

FIG. 10 is an exemplary diagram which shows a schematic configuration of an image removal apparatus provided with an image forming apparatus according to a fifth embodiment.

In the fifth embodiment, an inkjet printing unit 105 is provided in place of the image forming unit 103 shown in FIG. 1. The inkjet printing unit 105 comprises a drum 111 (which is an endless device), a line head unit 112, a drying unit 113 and a sheet separation unit 114.

The drum 111 can rotate at a predetermined circumferential speed and is configured to attract and hold a sheet P on the outer circumferential surface thereof. The line head unit 112 comprises line heads 112-C, 112-M, 112-Y and 112-K for respective colors of C (Cyan), M (Magenta), Y (Yellow) and K (key color: Black). The line heads 112-C, 112-M, 112-Y and 112-K are arranged in a direction orthogonal to the rotating direction Y of the drum 111 (i.e., the main scanning direction), and can perform printing in the main scanning direction at a time.

The drying unit 113 dries the ink on sheet P by blowing air or heated air against sheet P. The sheet separation unit 114 separates sheet P (on which an image is formed and the ink is dried) from the drum 111 by means of a separation claw, and supplies the sheet toward a downward portion of a sheet supply path.

Since the operation of the image forming apparatus of the fifth embodiment is similar to those of the second to fourth embodiments, a detailed description of the operation will be omitted.

In addition, each function which is described in the above described embodiments may be configured using hardware, or may be realized by allowing a computer to read a program in which each function is described, using software. In addition, each function may be configured by appropriately selecting either the software or the hardware.

Further, each function may be realized by allowing the computer to read programs which are stored in a recording medium (not shown). Here, if the recording medium according to the embodiment is a recording medium which can record programs and can be read by the computer, any type of recording format thereof may be used.

Further, in the embodiment, the fixing unit of the image forming apparatus has a color erasing function of the color erasing toner or color erasing ink; however, the fixing unit may not have the color erasing function. In such a case, when the image of the color erasing toner or color erasing ink is removed, the image of the color erasing toner may be removed using a removal apparatus which includes a sheet feeding unit and a color erasing unit and does not include an image forming unit.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a reading unit configured to read a printed surface of a recording medium in which a first image is formed of a color erasable recording material;

an image forming unit configured to form an image on the printed surface of the recording medium; and a controller configured to control the image forming unit in a manner to form a second image covering the first image by a color erasable recording material on the printed surface of the recording medium according to the reading result, wherein, if a print rate of the recording medium on which the first image is formed is equal to or more than a predetermined value, the controller sets the second image as an image having a uniform pattern covering an entire surface of the printed surface of the recording medium, wherein, if a print rate of the recording medium on which the first image is formed is lower than the predetermined value, the controller sets the second image in a manner to be formed of an image having a uniform pattern printed on an area covering a printed portion of the first image.

2. The apparatus according to claim 1:

wherein, the uniform pattern is a solid pattern, a half tone pattern, or a parallel line pattern.

3. An image forming apparatus comprising:

a reading unit configured to read a printed surface of a recording medium in which a first image is formed of a color erasable recording material;

an image forming unit configured to form an image on the printed surface of the recording medium; and a controller configured to control the image forming unit in a manner to form a second image covering the first image by a color erasable recording material on the printed surface of the recording medium according to the reading result, wherein, if a number of a plurality of areas covering a printed portion of the first image is equal to or more than a predetermined value, the controller sets the second image as an image having a uniform pattern covering an entire surface of the printed surface of the recording medium, wherein, if the number of areas is smaller than the predetermined value, the controller sets the second image in a manner to be formed of an image having a uniform pattern printed on an area covering a printed portion of the first image.

4. An image forming apparatus comprising:

a reading unit configured to read a printed surface of a recording medium in which a first image is formed of a color erasable recording material;

an image forming unit configured to form an image on the printed surface of the recording medium; and a controller configured to control the image forming unit in a manner to form a second image covering the first image by a color erasable recording material on the printed surface of the recording medium according to the reading result, wherein, the controller obtains a concentration of a printed portion of the first image; allows a different plurality of image patterns to correspond to each other in a manner that a concentration of the image pattern is proportional to the concentration of the printed portion; sets of an area covering the printed portion of the first image; and sets the second image in a manner to be formed of an image having a pattern corresponded to the concentration of the printed portion and printed on the area.

5. The apparatus according to claim 4:

wherein, the different plurality of patterns include a solid pattern, a half tone pattern, or a parallel line pattern.

6. An image forming method comprising:

reading a printed surface of a recording medium in which a first image is formed of a color erasable recording material; and forming a second image covering the first image by a color erasable recording material on the printed surface of the recording medium according to the reading result, wherein, if a print rate of the recording medium on which the first image is formed is equal to or more than a predetermined value, the controller sets the second image as an image having a uniform pattern covering an entire surface of the printed surface of the recording medium, wherein, if a print rate of the recording medium on which the first image is formed is lower than the predetermined value, the controller sets the second image in a manner to be formed of an image having a uniform pattern printed on an area covering a printed portion of the first image.

7. The method according to claim 6:

wherein, the uniform pattern is a solid pattern, a half tone pattern, or a parallel line pattern.

8. An image forming method comprising:

reading a printed surface of a recording medium in which a first image is formed of a color erasable recording material; and forming a second image covering the first image by a color erasable recording material on the printed surface of the recording medium according to the reading result, wherein, in a case where a number of a plurality of areas covering a printed portion of the first image is equal to or more than a predetermined value, the second image is an image having a uniform pattern covering an entire surface of the printed surface of the recording medium, wherein, in a case where the number of areas is smaller than the predetermined value, the second image is an image having a uniform pattern printed on an area covering a printed portion of the first image.

9. An image forming method comprising:

reading a printed surface of a recording medium in which a first image is formed of a color erasable recording material;

forming a second image covering the first image by a color erasable recording material on the printed surface of the recording medium according to the reading result, obtaining a concentration of a printed portion of the first image;

allowing a different plurality of image patterns to correspond to each other in a manner that a concentration of the image pattern is proportional to the concentration of the printed portion; and setting an area covering the printed portion of the first image, the second image being an image having a pattern corresponded to the concentration of the printed portion and printed on the area.

10. The method according to claim 9:

wherein, the different plurality of patterns include a solid pattern, a half tone pattern, or a parallel line pattern.

* * * * *